US011380505B2

(12) United States Patent
Lin

(10) Patent No.: US 11,380,505 B2
(45) Date of Patent: Jul. 5, 2022

(54) ULTRA-SMALL ELECTROMAGNETIC RELAY WITH HIGH STATIONARY CONTACT POSITIONING PRECISION

(71) Applicant: Xiamen Hongfa Signal Electronics Co., Ltd., Xiamen (CN)

(72) Inventor: Jiabin Lin, Xiamen (CN)

(73) Assignee: Xiamen Hongfa Signal Electronics Co., Ltd., Xiamen (CN)

( * ) Notice: Subject to any disclaimer, the term of this patent is extended or adjusted under 35 U.S.C. 154(b) by 565 days.

(21) Appl. No.: 16/473,619

(22) PCT Filed: Apr. 25, 2018

(86) PCT No.: PCT/CN2018/084478
§ 371 (c)(1),
(2) Date: Jun. 25, 2019

(87) PCT Pub. No.: WO2018/201949
PCT Pub. Date: Nov. 8, 2018

(65) Prior Publication Data

US 2019/0341210 A1 Nov. 7, 2019

(30) Foreign Application Priority Data

May 5, 2017 (CN) ..... 201710311555.1

(51) Int. Cl.
*H01H 50/02* (2006.01)
*H01H 51/28* (2006.01)
(Continued)

(52) U.S. Cl.
CPC ..... *H01H 51/281* (2013.01); *H01H 1/60* (2013.01); *H01H 9/00* (2013.01); *H01H 50/02* (2013.01);
(Continued)

(58) Field of Classification Search
CPC ..... H01H 1/60; H01H 9/00; H01H 49/00; H01H 50/02; H01H 50/043; H01H 50/14;
(Continued)

(56) References Cited

U.S. PATENT DOCUMENTS

2010/0039196 A1 2/2010 Yokoyama et al.

FOREIGN PATENT DOCUMENTS

CN 201527934 U 7/2010
CN 206022248 U 3/2017
(Continued)

OTHER PUBLICATIONS

Chinese Office Action dated Feb. 3, 2019 in connection with Chinese Application No. 201710311555.1.
(Continued)

*Primary Examiner* — Ramon M Barrera
(74) *Attorney, Agent, or Firm* — Wolf, Greenfield & Sacks, P.C.

(57) ABSTRACT

The disclosure provides an ultra-small electromagnetic relay with high stationary contact positioning precision, comprises: a stationary spring, a bobbin and a base which are integrated by injection molding, the stationary spring comprises a stationary spring body on which stationary contacts are disposed and a leading-out terminal of the stationary spring extending from the stationary spring body to an outer part of the base; in the leading-out terminal, a first positioning part is disposed at a position corresponding to an edge of the base; in the stationary spring body, a convex extending part extending outside the base is designed as a second positioning part; in the base, a through hole formed through the base of is provided at a position corresponding to a back surface of the stationary spring body on which the stationary contact is mounted, the back surface is designed as a third positioning part during injection molding.

11 Claims, 13 Drawing Sheets

(51) Int. Cl.

| | |
|---|---|
| ***H01H 51/06*** | (2006.01) |
| ***H01H 9/00*** | (2006.01) |
| ***H01H 1/60*** | (2006.01) |
| *H01H 50/04* | (2006.01) |

(52) U.S. Cl.
CPC ..... *H01H 51/06* (2013.01); *H01H 51/282* (2013.01); *H01H 50/043* (2013.01)

(58) Field of Classification Search
CPC ..... H01H 50/56; H01H 51/06; H01H 51/28; H01H 51/282
See application file for complete search history.

(56) References Cited

FOREIGN PATENT DOCUMENTS

| | | | |
|---|---|---|---|
| CN | 106992101 | A | 7/2017 |
| CN | 206789501 | U | 12/2017 |
| JP | 2010044974 | A | 2/2010 |

OTHER PUBLICATIONS

International Search Report and Written Opinion for International Application No. PCT/CN2018/084478 dated Jun. 28, 2018.

ULTRA-SMALL ELECTROMAGNETIC RELAY WITH HIGH STATIONARY CONTACT POSITIONING PRECISION

RELATED APPLICATIONS

This Application is a national stage filing under 35 U.S.C. 371 of International Patent Application Serial No. PCT/CN2018/084478, filed Apr. 25, 2018, entitled "ULTRA-SMALL ELECTROMAGNETIC RELAY WITH HIGH STATIC CONTACT POINT POSITIONING PRECISION". Foreign priority benefits are claimed under 35 U.S.C. § 119(a)-(d) or 35 U.S.C. § 365(b) of Chinese application number 201710311555.1, filed May 5, 2017.

TECHNICAL FIELD

The present disclosure relates to the technical field of relay, in particular to an ultra-small electromagnetic relay with high stationary contact positioning precision.

BACKGROUND

In the related art, the stationary spring, the base and the bobbin of a relay are generally formed by integral combined injection molding, thereby achieving an effect of reducing volume and improving insulation capacity. Stationary contacts have been welded on the stationary spring before the stationary spring, the base and the bobbin are injection molded. Therefore, how to ensure positioning precision of the stationary spring during injection molding, and then ensure positioning precision of the stationary contact has a great influence on consistency of the product.

An ultra-small electromagnetic relay in the related art is shown in FIG. 1 to FIG. 5. FIG. 1 is a structural schematic diagram of stationary spring strips in the related art. FIG. 2 is a schematic diagram of a stationary spring and a bobbin matching with each other in the related art. FIG. 3 is a schematic diagram of a stationary spring and a bobbin matching with each other (in a reverse state relative to the structure of FIG. 2) in the related art. FIG. 4 is a structural schematic diagram of a stationary spring, a bobbin and a base which are integrated by injection molding in the related art. FIG. 5 is a structural schematic diagram of a stationary spring, a bobbin and a base which are integrated by injection molding (in a reverse state relative to the structure of FIG. 4) in the related art, wherein a stationary contact 102 has been welded on a contact surface 101 of a stationary spring 100. After the stationary spring 100 is matched with the bobbin 103, the stationary spring 100, the bobbin 103 and the base 104 are formed an integrated structure by injection molding. In the ultra-small electromagnetic relay, when a contact part of the stationary spring 100 and the bobbin 103 are formed a base structure by the injection molding, the positioning location of the stationary spring 100 in a mold is generally at an edge of the stationary spring close to an outside of the base. In the related art, two locations positioning method is adopted to achieve positioning the contact 102 of the stationary spring 100. wherein a first positioning is at a leading-out terminal of the stationary spring along a width direction of the base, which is equivalent to providing a first positioning part 105 at the leading-out terminal of the stationary spring 100. A second positioning is at a local leading-out terminal along a length direction of the base, which is equivalent to providing a second positioning part 106 at an end of one side of the contact surface 101 of the stationary spring 100. Since a direct positioning of a center position of the contact of the stationary spring 100 is not achieved, the positioning method has following drawbacks.

1. The positioning is not complete and stable. The direct positioning is not performed at a contact position of the stationary spring. If the stationary spring at the contact position is slightly deformed and tilted and is not corrected by the positioning, it will result in poor positional consistency of the contact after the injection molding is performed to form the base, thereby affecting the consistency of parameters such as a contact gap and overtravel of the relay, and not conducive to improve product productivity and performance consistency.

2. The positioning at the contact position is unstable, which is easy to result in that the contact position of the stationary spring will be impacted by the flow of liquid plastic injected from the mold gate when the base is injection molded, and then the stationary spring is easy to be deformed in a direction of opening and closing of the mold, and a gap is generated between the stationary spring and the mold, all of which results in occurrence of injection burrs at the position and affects performance quality of the product. The method in the related art for dealing with these defects is generally to reduce direct impact of the liquid plastic at the contact position of the stationary spring by changing structures of the gate and location of components of the base, or by changing the parameters of process of the injection molding. These changes will greatly increase the difficulty of design of the base and the mold and production control.

3. Since the position of the surface of the stationary spring is close to the mold cavity (the terminal protruding at the position of the stationary spring contact, that is, a part where the second positioning part 106 is covered with plastic in the length direction of the base), it is easy to cause the stationary spring to interfere with the mold and then damage the mold, and affect the cost and efficiency of manufacturing.

SUMMARY

The technical solution adopted by the present disclosure to solve the technical problem thereof is as follows. An ultra-small electromagnetic relay with high stationary contact positioning precision including a stationary spring, a bobbin and a base which are integrated by injection molding, and the stationary spring includes a stationary spring body on which stationary contacts are disposed and a leading-out terminal of the stationary spring extending from the stationary spring body to an outer part of the base; in the leading-out terminal of the stationary spring, a first positioning part configured to position the stationary spring during injection molding is disposed at a position corresponding to an edge in a width direction W of the base; wherein in the stationary spring body, a convex extending part is provided in a length direction L corresponding to the base, and the convex extending part extends outside the base and is designed as a second positioning part during the injection molding; in the base, a through hole formed through the base in the thickness direction T of the base is provided at a position corresponding to a back surface of the stationary spring body on which the stationary contact is mounted, the back surface of the stationary spring body on which the stationary contact is mounted is designed as a third positioning part during injection molding, so that the positioning part can be supported and positioned by a positioning member inserting through of the through hole of the base.

The convex extending part extending outside the base and designed as a second positioning part during injection molding may be cut off to stretch out or not stretch out the outside of the base in the length direction L of the base after the injection molding is completed.

The bobbin is located between the stationary spring body of the stationary spring and the base, and the bobbin is configured to give way to the through hole of the base, so that a positioning member passing through the through hole of the base can bypass the bobbin at a back surface of the stationary contact to support and position the third positioning part of the stationary spring body.

One end which is close to the inner position of the base of the through hole is abutted against the back surface of the stationary spring body being opposite to the stationary contact or the back surface of the stationary spring body close to the stationary contact.

A cross-section of the through hole is designed as a circular shape or a square shape or a triangular shape or a polygon shape or an ellipse shape.

The diameter of the through hole is gradually decreased in the direction from the outer position to the inner position of the base.

The edge of the stationary spring body of the stationary spring is provided with at least one hook which is integrally extended outwardly and bent by the static spring body, and the hook is embedded in the base.

A bending angle of the hook is approximately 90 degrees.

The size of the hook is gradually increased from the root part toward the free end of the hook.

The embodiments of the present disclosure are further described in detail below with reference to accompanying drawings. However, the structure of the present disclosure is not limited to illustrated embodiments.

DETAILED DESCRIPTION

Embodiment

Figure 1:
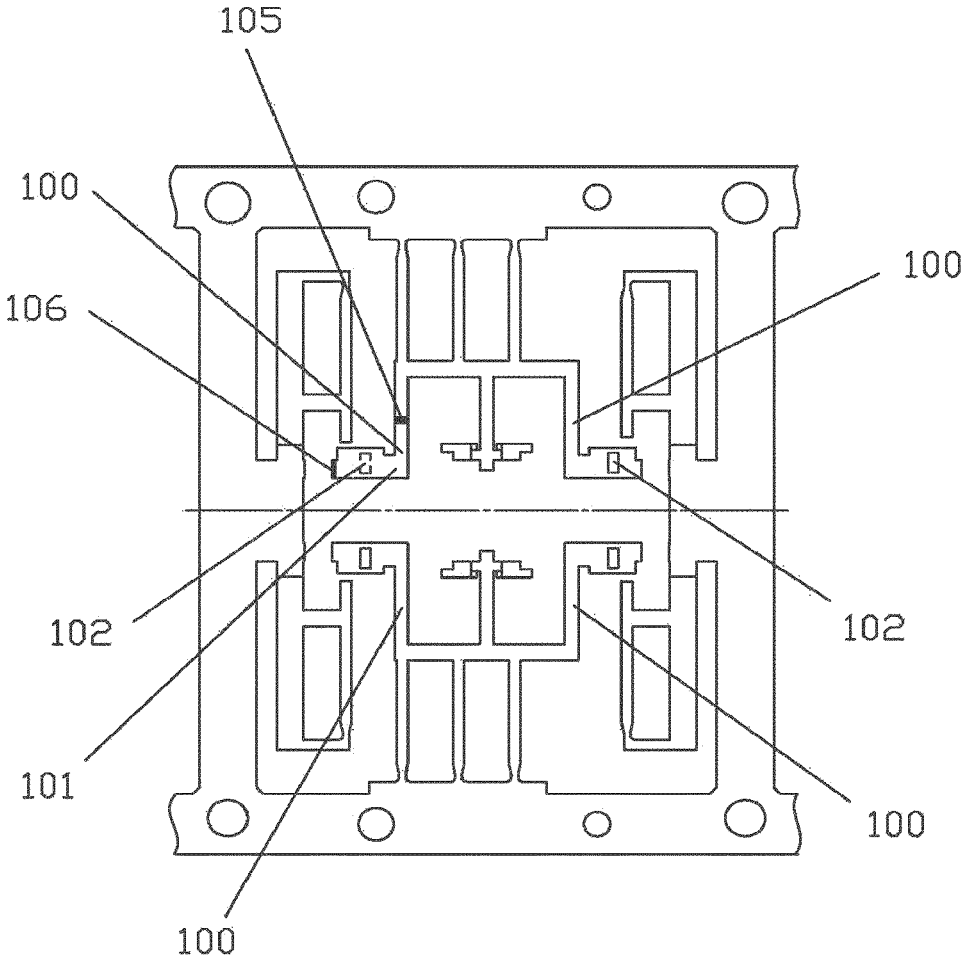
Fig.1 (Prior Art)
FIG. 1 is a structural schematic diagram of stationary spring strips in the related art.
Figure 2:
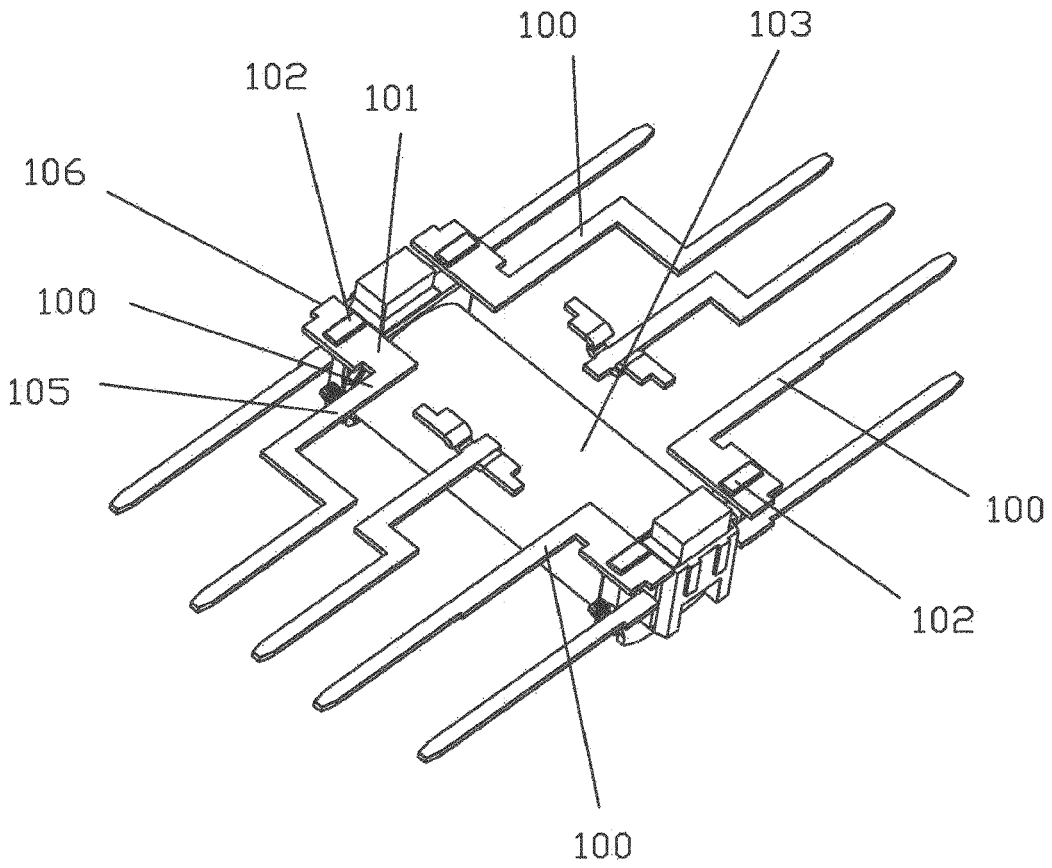
Fig.2 (Prior Art)
FIG. 2 is a schematic diagram of a stationary spring and a bobbin matching with each other in the related art.
Figure 3:
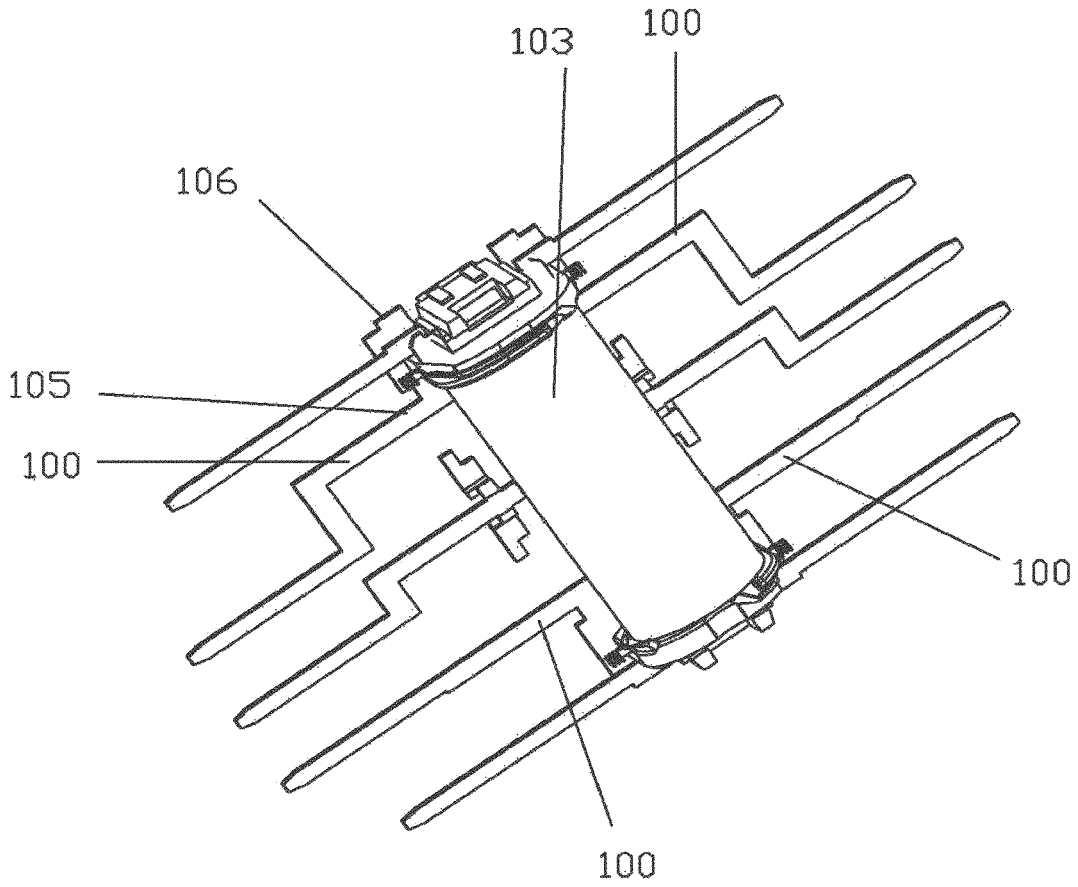
Fig.3 (Prior Art)
FIG. 3 is a schematic diagram of a stationary spring and a bobbin matching with each other (in a reverse state relative to the structure of FIG. 2) in the related art.
Figure 4:
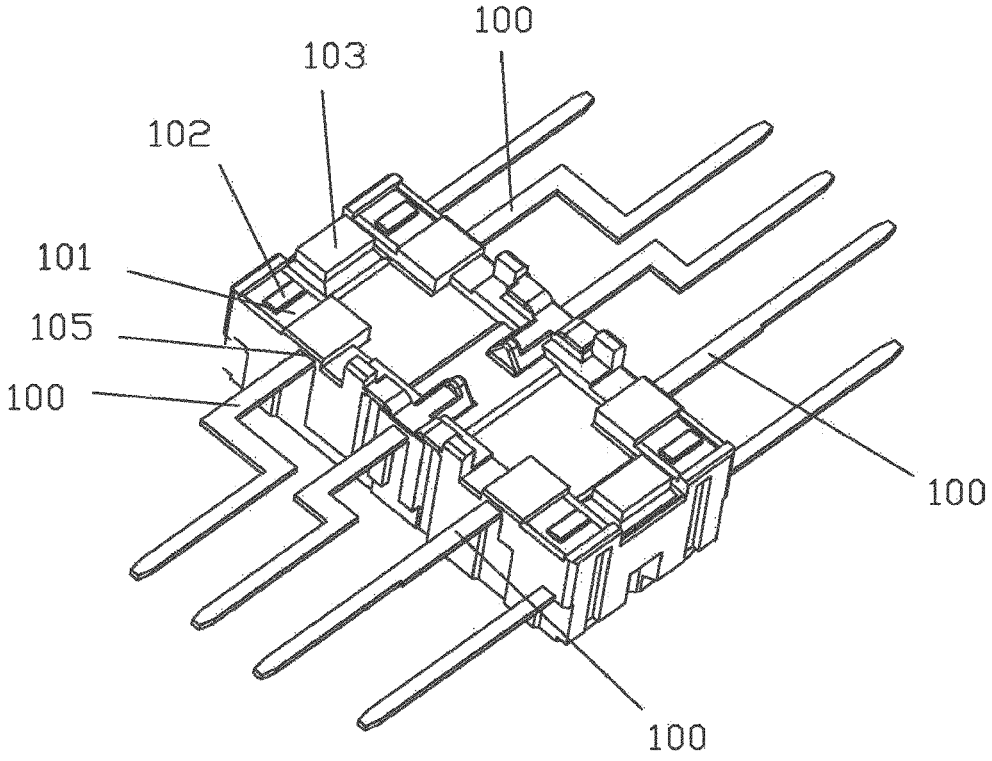
Fig.4 (Prior Art)
FIG. 4 is a structural schematic diagram of a stationary spring, a bobbin and a base which are integrated by injection molding in the related art.
Figure 5:
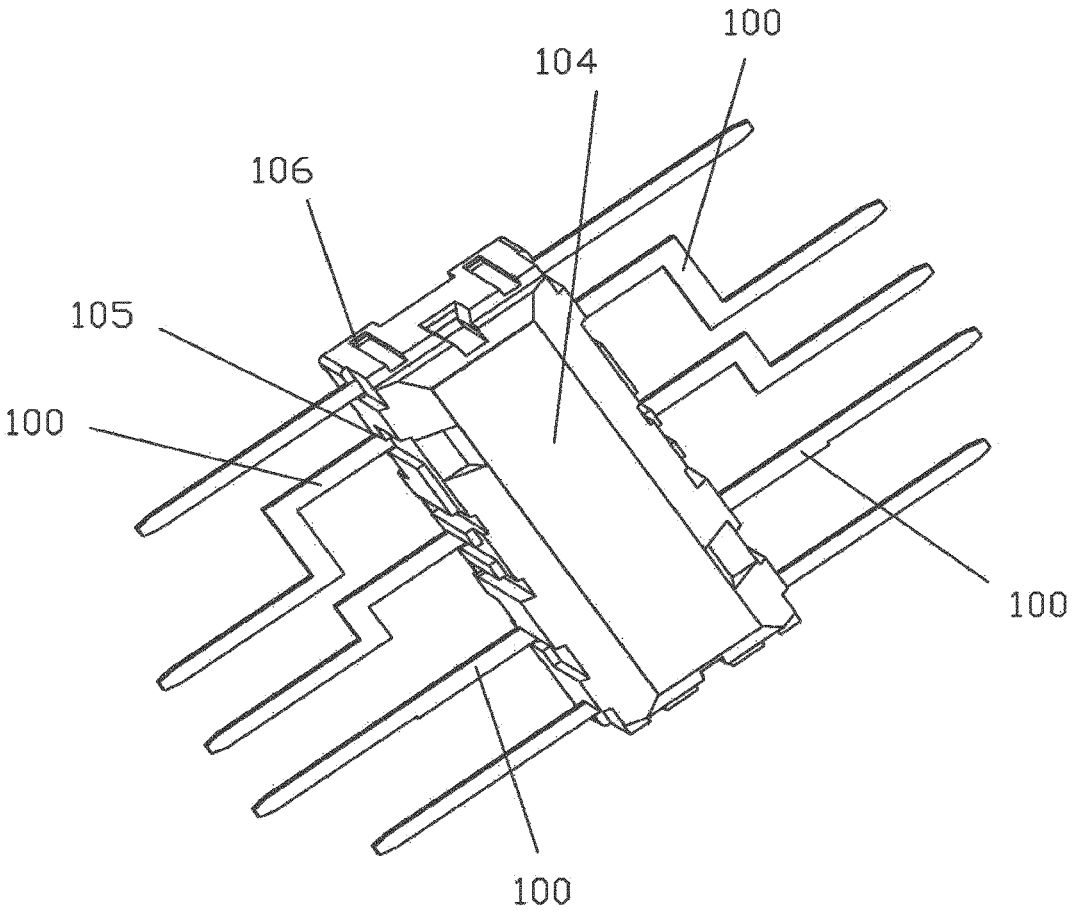
Fig.5 (Prior Art)
FIG. 5 is a structural schematic diagram of a stationary spring, a bobbin and a base which are integrated by injection molding (in a reverse state relative to the structure of FIG. 4) in the related art.
Figure 6:
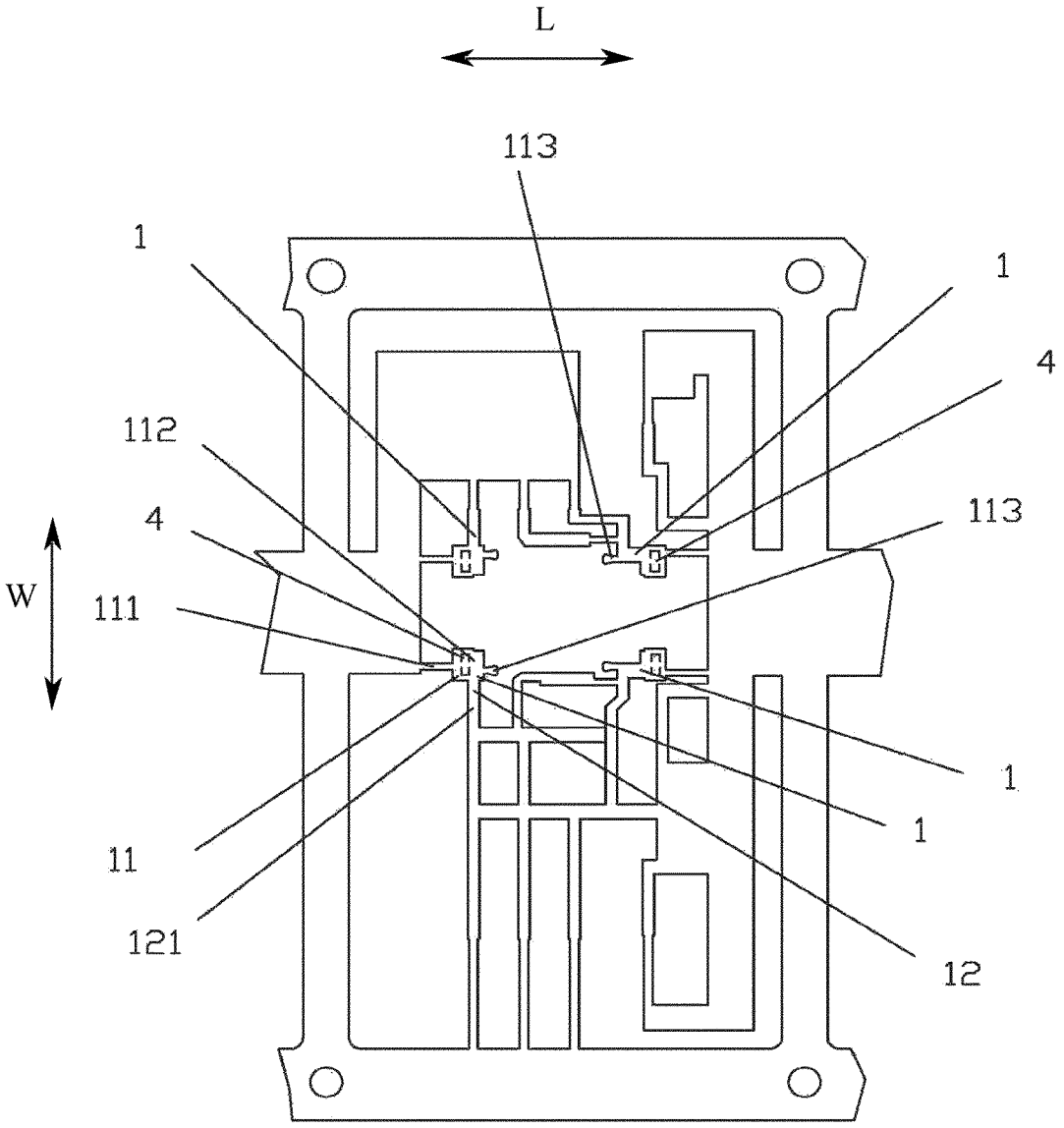
FIG. 6 is a structural schematic diagram of a stationary spring strips of an embodiment of the present disclosure.
Figure 7:
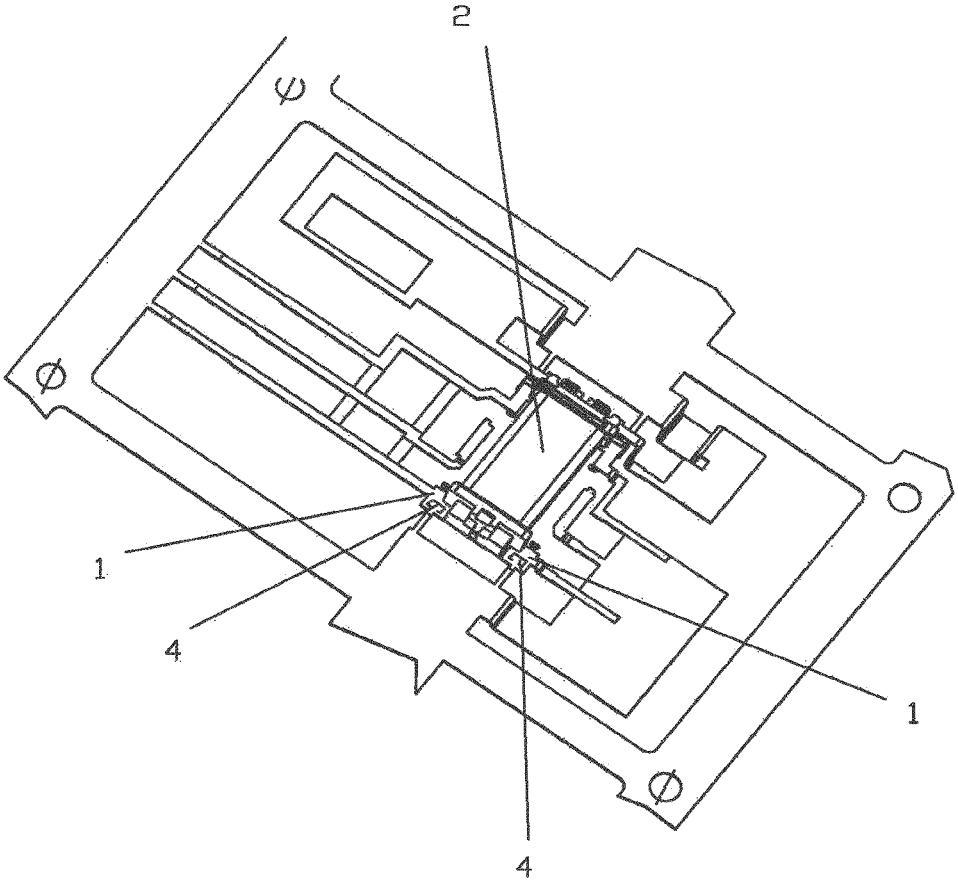
FIG. 7 is a perspective schematic diagram of a stationary spring and a bobbin matching with each other of an embodiment of the present disclosure.
Figure 8:
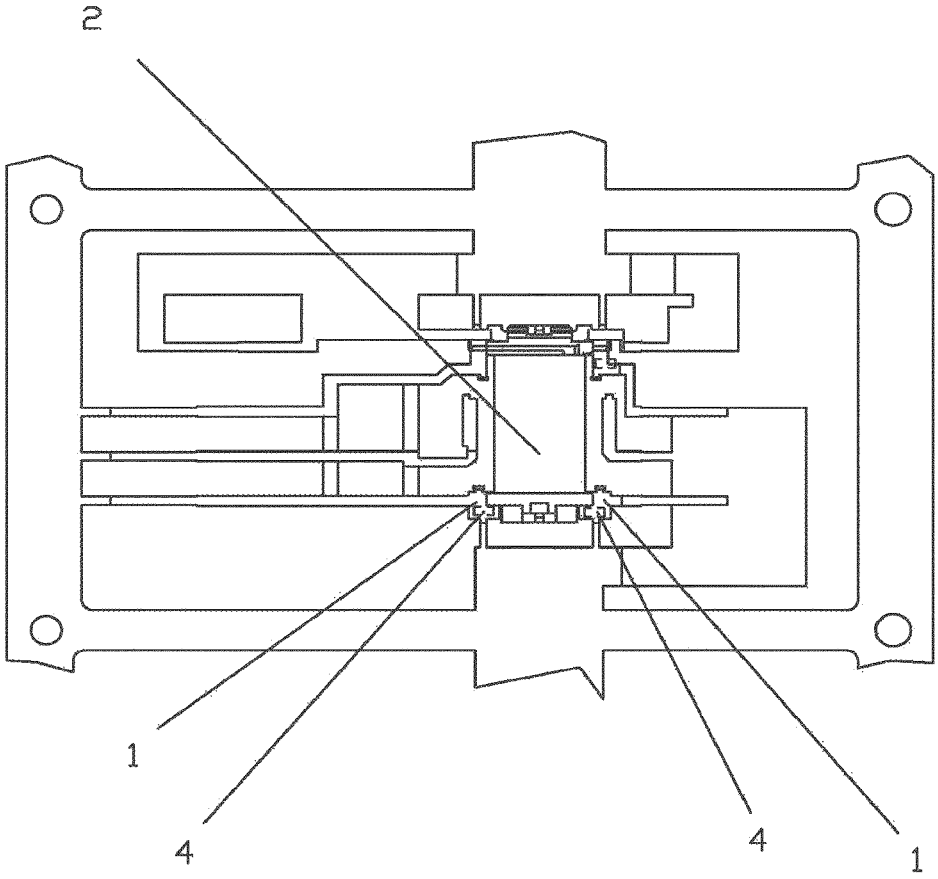
FIG. 8 is a top view of the structure shown in FIG. 7.
Figure 9:
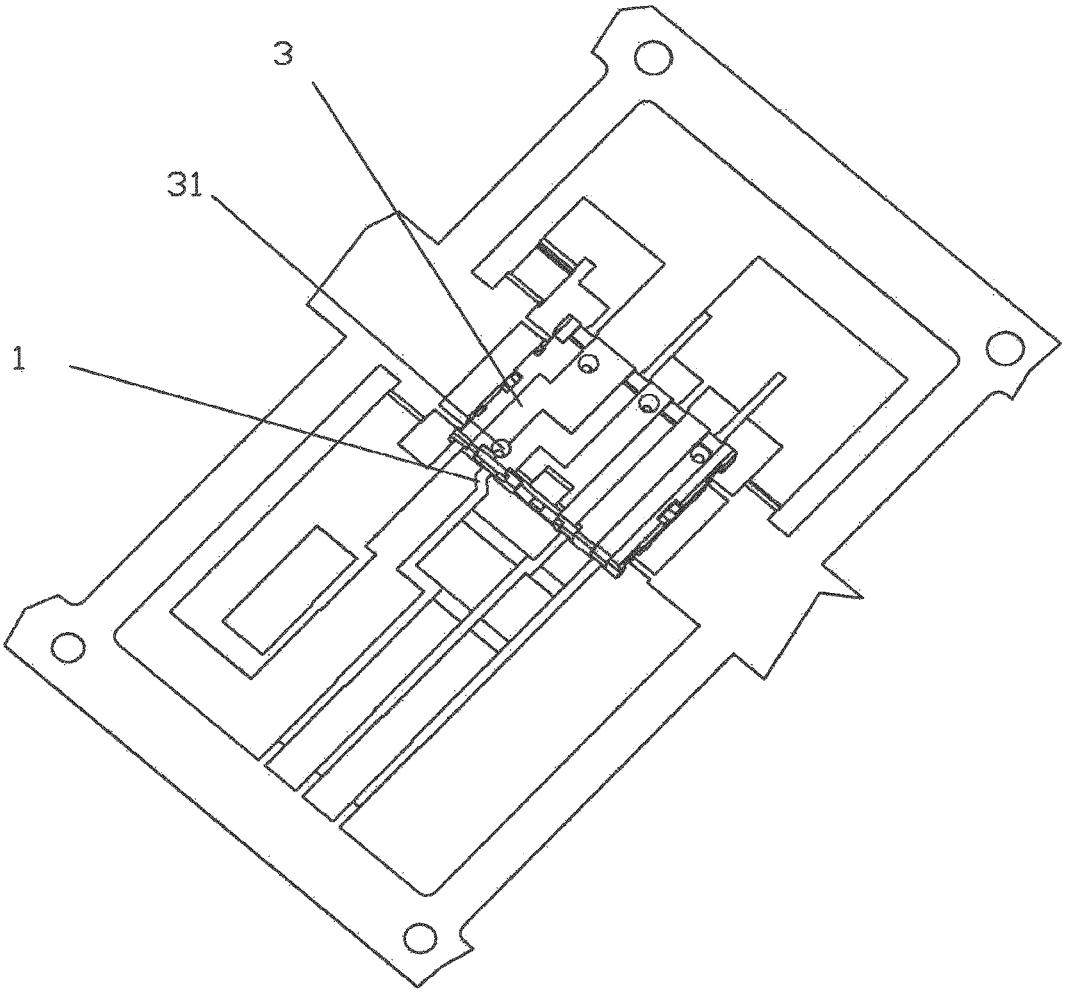
FIG. 9 is a perspective schematic diagram of the integrated structure of a stationary spring, a bobbin and a base are integrally molded by injection molding in an embodiment of the present disclosure.
Figure 10:
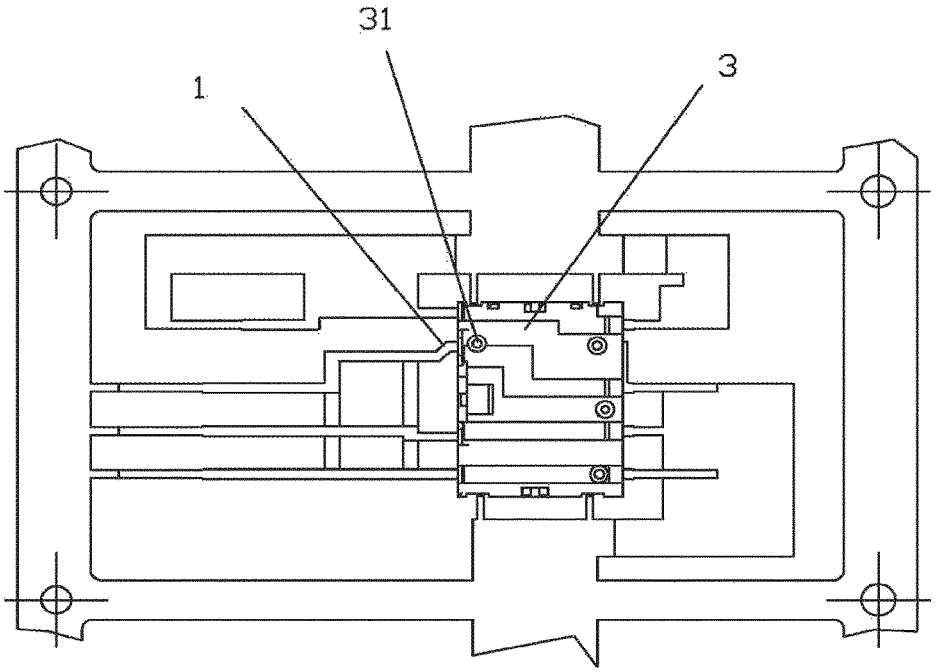
FIG. 10 is a top view of the structure shown in FIG. 9.
Figure 11:
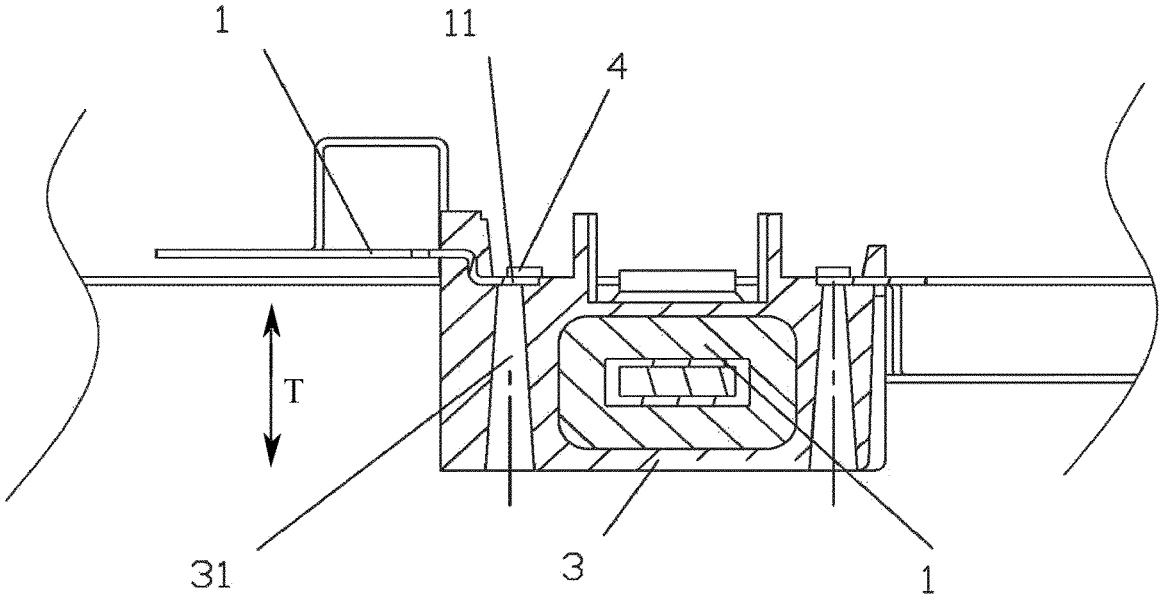
FIG. 11 is a cross-sectional view of the integrated structure of a stationary spring, a bobbin and a base are integrally molded by injection molding in an embodiment of the present disclosure.
Figure 12:
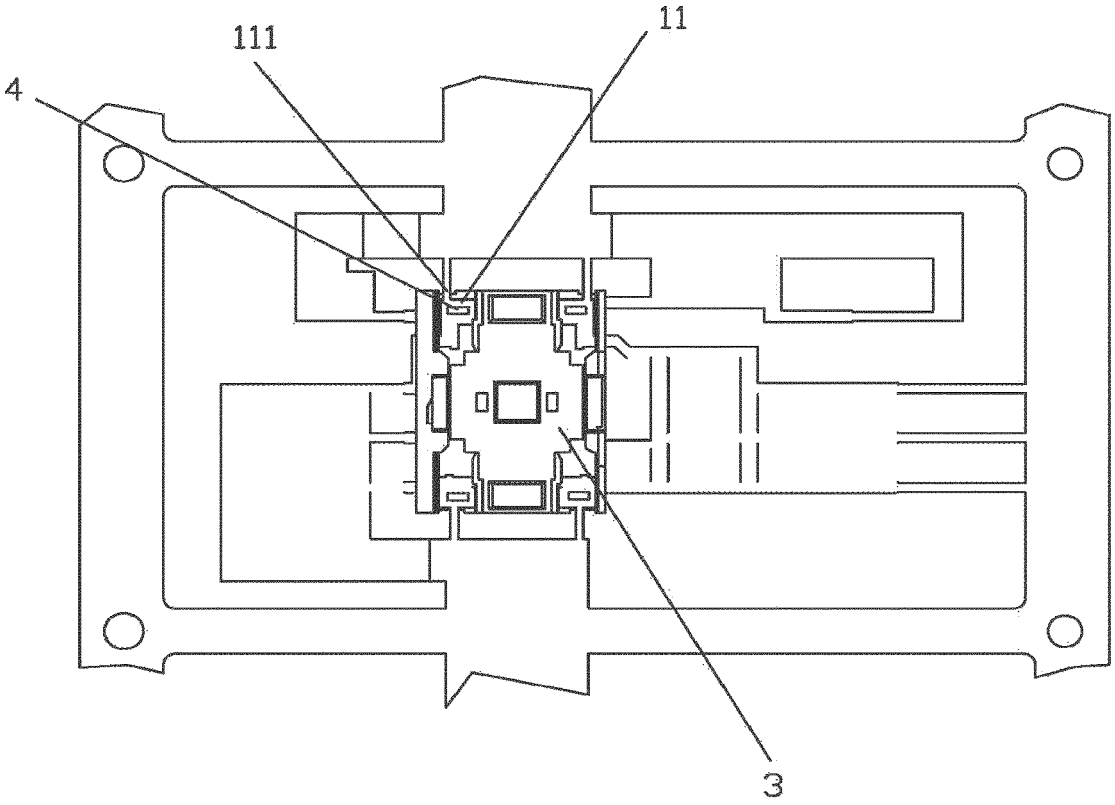
FIG. 12 is a structural schematic diagram of the integrated structure of a stationary spring, a bobbin and a base are integrally molded by injection molding in an embodiment of the present disclosure.
Figure 13:
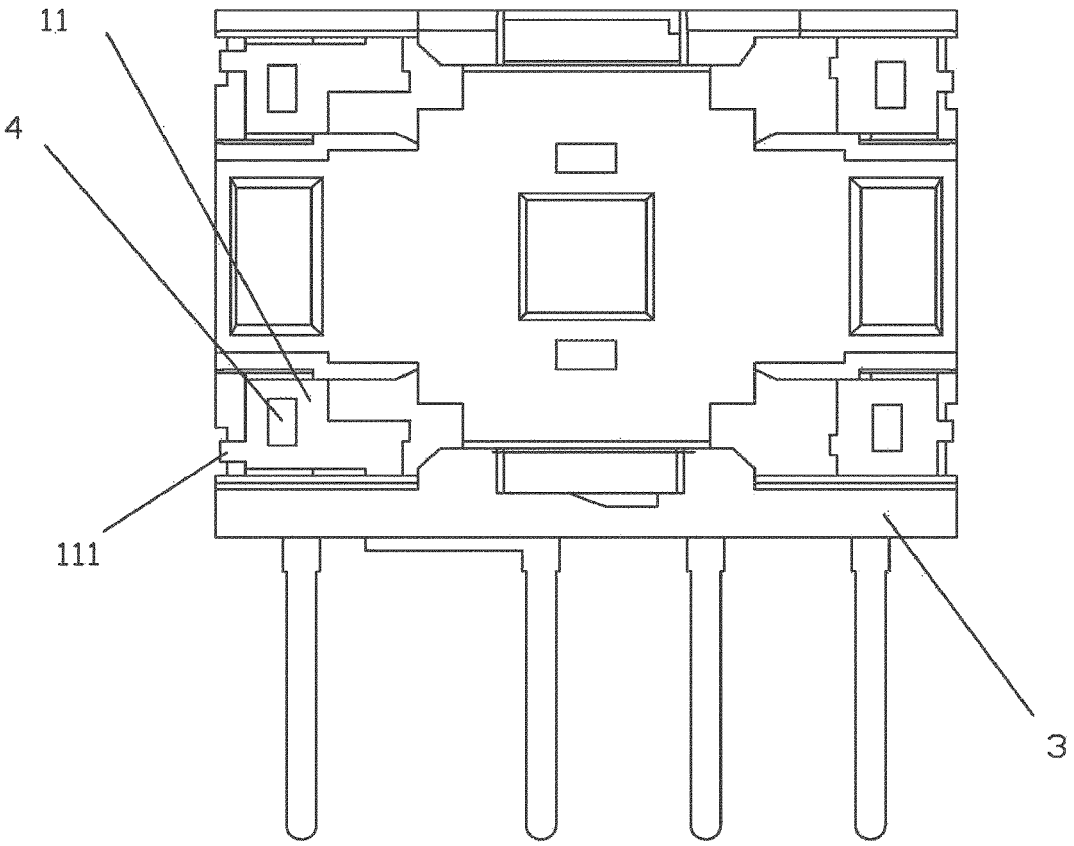
FIG. 13 is a structural schematic diagram of the integrated structure of a stationary spring, a bobbin and a base are integrally molded by injection molding (after cutting a convex extending part) in an embodiment of the present disclosure.
Figure 14:
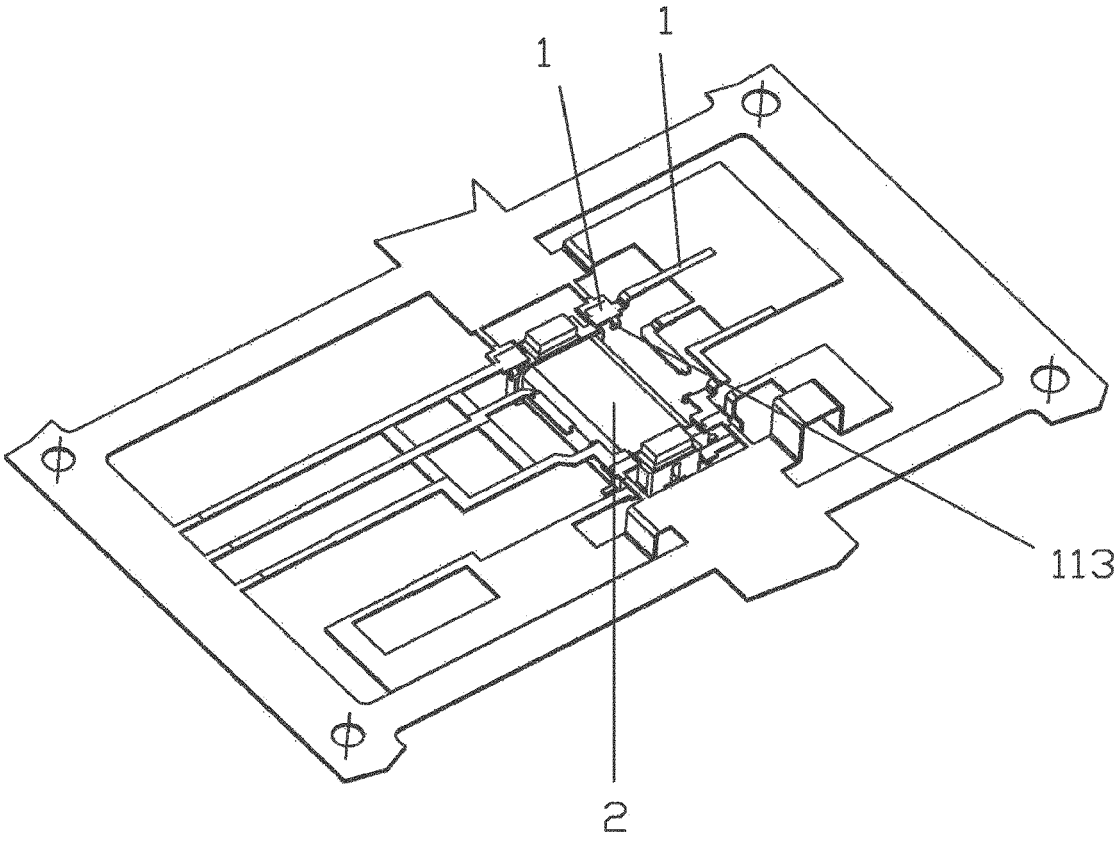
FIG. 14 is a perspective schematic diagram of a stationary spring and a bobbin matching with each other (after a hook is bent and formed) of an embodiment of the present disclosure.

Referring to FIG. 6 to FIG. 14, an ultra-small electromagnetic relay with high stationary contact positioning precision of the present disclosure includes a stationary spring 1, a bobbin 2 and a base 3 which are integrated by injection molding. The stationary spring 1 includes a stationary spring body 11 on which stationary contacts 4 are disposed and a leading-out terminal 12 of the stationary spring extending from the stationary spring body 11 to an outer part of the base 3. In the leading-out terminal 12 of the stationary spring, a first positioning part 121 configured to position the stationary spring during injection molding is disposed at a position corresponding to an edge in a width direction W of the base 3 (as shown in FIG. 6). In the stationary spring body 11, a convex extending part 111 is provided in a length direction L (as shown in FIG. 6) corresponding to the base 3. The convex extending part 111 extends outside the base and is designed as a second positioning part during injection molding. In the base 3, a through hole 31 formed through the base 3 in the thickness direction T (as shown in FIG. 11) of the base 3 is provided at a position corresponding to a back surface of the stationary spring body on which the stationary contact 4 is mounted, the back surface of the stationary spring body on which the stationary contact 4 is mounted is designed as a third positioning part 112 during injection molding, so that the positioning part 112 can be supported and positioned by a positioning member inserting through the through hole 31 of base 3. In the present embodiment, the leading-out terminal 12 of stationary spring 1 protrudes in the width direction W of the base. The thickness of the base is further referred as the height of the base.

In the present embodiment, the convex extending part 111 extending outside the base and designed as a second positioning part during injection molding may be cut off to stretch out or not to stretch out the outside of the base in the length direction of the base 3 after the injection molding is completed (as shown in FIG. 6). That is to say, after the injection molding of the base 3 is completed, the convex extending part 111 extending out is cut off, and the convex extending part 111 after cutting off is exposed to the outside of the base in the length direction L of the base or not exposed to the outside of the base in the length direction L of the base.

In the present embodiment, the bobbin 2 is located between the stationary spring body 11 of the stationary spring and the base. The bobbin 2 is configured to give way to the through hole 31 of the base, so that a positioning member inserting through the through hole 31 of the base can bypass the bobbin 2 at a back surface of the stationary contact 4 to support and position the third positioning part 112 of the stationary spring body 11.

In the present embodiment, one end which is close to the inner position of the base of the through hole 31 is abutted against the back surface of the stationary spring body 11 being opposite to the stationary contact 4 or the back surface of the stationary spring body 11 close to the stationary contact 4.

In the present embodiment, a cross-section of the through hole 31 is designed as a circular shape. Of course, the cross-section of the through hole may further be designed as a square shape or a triangular shape or a polygon shape or an ellipse shape or other suitable shapes.

In the present embodiment, the diameter of the through hole 31 is gradually decreased in the direction from the outer position to the inner position of the base. A cross-sectional area of the through hole 31 is small in contact with the position of the stationary spring (that is, the area close to the inner position of the base is small), and is large close to the outer position of the base, which forms a tapered shape to achieve an effect of being convenient for releasing the mold. Positions of non-contact surfaces of the through hole, the bobbin and the stationary spring are isolated by plastic.

In the present embodiment, the edge of the stationary spring body 11 of the stationary spring is provided with a hook 113 which is integrally extended outwardly and bent by the stationary spring body, and the hook 113 is embedded in the base 3. Multiple hooks can be further provided as needed.

In the present embodiment, a bending angle of the hook 113 is approximately 90 degrees, and of course, may further be other bending angles less than 90 degrees, such as 80 degrees, 65 degrees, etc.

In the present embodiment, the size of the hook 113 is gradually increased from the root part toward the free end of the hook. That is, the hook is designed as a reverse cone shape having a small width close to a contact surface and a large width away from the contact surface. In this case, most part of the hook away from the contact surface is hidden in the plastic of the base. The hook and metal parts of other parts are isolated by plastic.

The ultra-small electromagnetic relay with high stationary contact positioning precision of the present disclosure adopts that in the stationary spring body 11, an extended convex extending part 111 is provided in a length direction L corresponding to the base 3. The convex extending part 111 extends outside the base 3 as a second positioning part during injection molding. In the base 3, a through hole 31 formed through the base 3 in the thickness direction T of the base 3 is provided at a position corresponding to a back surface of the stationary spring body on which the stationary contact 4 is mounted, the back surface of the stationary spring body on which the stationary contact 4 is mounted is designed as a third positioning part 112 during injection molding, so that the positioning part 112 can be supported and positioned by a positioning member inserting through the through hole 31 of the base 3. The present disclosure changes the positioning of a convex terminal at a contact position of the stationary spring along the length direction L of the base as a manner of exposing the plastic of the base, so that the convex terminal does not need to be precisely matched with the mold cavity, thereby reducing the risk of damage of the mold. In the present disclosure, the contact position of the stationary spring is supported and positioned by providing a through hole at the base, which greatly improves consistency and stability of the contact position.

The ultra-small electromagnetic relay with high stationary contact positioning precision of the present disclosure adopts that the edge of the stationary spring body 11 of the stationary spring is provided with at least one hook 113 which is integrally extended outwardly and bent by the stationary spring body, and the hook 113 is embedded in the base 3. The present disclosure is further increased positioning stability at the position of the contact surface of the stationary spring after injection molding by adding a positioning hook at the contact surface of the stationary spring. By cooperating with the second positioning part and the third positioning part, it is ensured that the position of the contact surface of the stationary spring is not deformed even suffered the impact of liquid plastic during injection molding, which greatly reduces the difficulty in designing the position of the gate of the base and designing structure of the mold, and is beneficial to reducing production cost and improving production efficiency, and can greatly improve the consistency of the position of the stationary spring contact during injection molding and after injection molding, thereby effectively improving contact gap of the product, the consistency of overtravel parameters and improving product quality.

The above are only preferred embodiments of the present disclosure and are not intended to limit the present disclosure in any form. While the present disclosure has been described above in the preferred embodiments, it is not intended to limit the present disclosure. Any person skilled in the art can make many possible variations and modifications to the technical solutions of the present disclosure by using the above-disclosed technical contents, or modify to equivalent embodiments without departing from the scope of the technical solutions of the present disclosure. Therefore, any simple modifications, equivalent changes, and modifications to the above embodiments in accordance with the technical essence of the present disclosure should fall within the scope of the present disclosure.

What is claimed is:

1. An ultra-small electromagnetic relay with high stationary contact positioning precision, comprising: a stationary spring, a bobbin and a base which are integrated by injection molding, and the stationary spring comprising a stationary spring body on which stationary contacts are disposed and a leading-out terminal of the stationary spring extending from the stationary spring body to an outer part of the base; in the leading-out terminal of the stationary spring, a first positioning part configured to position the stationary spring during injection molding is disposed at a position corresponding to an edge in a width direction of the base; wherein in the stationary spring body, a convex extending part is provided in a length direction corresponding to the base, and the convex extending part extending outside the base is designed as a second positioning part during injection molding; in the base, a through hole formed through the base in the thickness of the base is provided at a position corresponding to a back surface of the stationary spring body on which the stationary contact is mounted, the back surface of the stationary spring body on which the stationary contact is mounted is designed as a third positioning part during injection molding, so that the positioning part is supported and positioned by a positioning member inserting through the through hole of the base.

2. The ultra-small electromagnetic relay with high stationary contact positioning precision according to claim 1, wherein the convex extending part extending outside the base and designed as a second positioning part during injection molding is cut off to stretch out or not stretch out the outside of the base in the length direction of the base after the injection molding is completed.

3. The ultra-small electromagnetic relay with high stationary contact positioning precision according to claim 1, wherein the bobbin is located between the stationary spring body of the stationary spring and the base, and the bobbin is configured to give way to the through hole of the base, so that a positioning member passing through the through hole of the base can bypass the bobbin at a back surface of the stationary contact to support and position the third positioning part of the stationary spring body.

4. The ultra-small electromagnetic relay with high stationary contact positioning precision according to claim 1, wherein one end which is close to the inner position of the base of the through hole is abutted against the back surface of the stationary spring body being opposite to the stationary contact or the back surface of the stationary spring body close to the stationary contact.

5. The ultra-small electromagnetic relay with high stationary contact positioning precision according to claim 4, wherein a cross-section of the through hole is designed as a circular shape or a square shape or a triangular shape or a polygon shape or an ellipse shape.

6. The ultra-small electromagnetic relay with high stationary contact positioning precision according to claim 5, wherein the diameter of the through hole is gradually decreased in the direction from the outer position to the inner position of the base.

7. The ultra-small electromagnetic relay with high stationary contact point positioning precision according to claim 1, wherein the edge of the stationary spring body of the stationary spring is provided with at least one hook which is integrally extended outwardly and bent by the stationary spring body, and the hook is embedded in the base.

8. The ultra-small electromagnetic relay with high stationary contact positioning precision according to claim 7, wherein a bending angle of the hook is approximately 90 degrees.

9. The ultra-small electromagnetic relay with high stationary contact positioning precision according to claim 8, wherein the size of the hook is gradually increased from the root part toward the free end of the hook.

10. The ultra-small electromagnetic relay with high stationary contact positioning precision according to claim 4, wherein the diameter of the through hole is gradually decreased in the direction from the outer position to the inner position of the base.

11. The ultra-small electromagnetic relay with high stationary contact positioning precision according to claim 7, wherein the size of the hook is gradually increased from the root part toward the free end of the hook.

* * * * *